US011026494B2

(12) United States Patent
Lee

(10) Patent No.: US 11,026,494 B2
(45) Date of Patent: Jun. 8, 2021

(54) LIPSTICK VESSEL

(71) Applicant: SAMHWA CO., LTD., Uiwang-si (KR)

(72) Inventor: Kyung Chang Lee, Seoul (KR)

(73) Assignee: SAMHWA CO., LTD., Uiwang-si (KR)

( * ) Notice: Subject to any disclaimer, the term of this patent is extended or adjusted under 35 U.S.C. 154(b) by 89 days.

(21) Appl. No.: 16/477,066

(22) PCT Filed: Dec. 28, 2017

(86) PCT No.: PCT/KR2017/015689
§ 371 (c)(1),
(2) Date: Jul. 10, 2019

(87) PCT Pub. No.: WO2018/131828
PCT Pub. Date: Jul. 19, 2018

(65) Prior Publication Data

US 2019/0328110 A1 Oct. 31, 2019

(30) Foreign Application Priority Data

Jan. 11, 2017 (KR) ..... 10-2017-0003960

(51) Int. Cl.
*A45D 40/06* (2006.01)
*A45D 40/00* (2006.01)
(Continued)

(52) U.S. Cl.
CPC ..... *A45D 40/06* (2013.01); *B65D 83/0011* (2013.01); *A45D 2040/0025* (2013.01);
(Continued)

(58) Field of Classification Search
CPC ..... A45D 40/06; A45D 2040/0025; A45D 2200/051; A45D 40/20; A45D 2040/00;
(Continued)

(56) References Cited

U.S. PATENT DOCUMENTS 6,200,047 B1 * 3/2001 Holloway ..... A45D 40/04 401/68
7,938,591 B2 * 5/2011 Kokai ..... A45D 40/04 401/75
8,328,447 B2 * 12/2012 Tani ..... A45D 40/04 401/172

FOREIGN PATENT DOCUMENTS

JP 08-266332 A 10/1996
JP 2009-045303 A 3/2009
(Continued)

*Primary Examiner* — David J Walczak
(74) *Attorney, Agent, or Firm* — Novick, Kim & Lee, PLLC; Jae Youn Kim

(57) ABSTRACT

A lipstick vessel includes: a cylindrical upper cover, the upper part of which is closed and the lower part thereof is opened; a shoulder of a cylindrical member, the upper and lower parts of which are opened, which is inserted into the lower opening of the upper cover; a lower cover of a cylindrical member, the upper part of which is opened and the lower part thereof is closed, and the upper opening portion thereof is inserted into the lower outer circumference of a circumferential protrusion protruding outward at a center of the shoulder; a rotating body of a cylindrical member, which is inserted into the lower cover to rotate integrally with the lower cover; and a lipstick holding member for holding a lipstick at the upper part thereof.

8 Claims, 8 Drawing Sheets

(51) Int. Cl.
*A45D 40/20* (2006.01)
*B65D 83/00* (2006.01)

(52) U.S. Cl.
CPC .. *A45D 2040/208* (2013.01); *A45D 2200/051* (2013.01); *B65D 83/0027* (2013.01)

(58) Field of Classification Search
CPC ..... A45D 2040/0062; A45D 2040/20; A45D 2040/208; A45D 2200/005; A45D 2200/10; B65D 83/0011; B65D 83/0016; B65D 83/0022; B65D 83/0027; B65D 83/0033; B65D 83/0005
USPC ..... 401/75, 77, 78, 171, 172, 174
See application file for complete search history.

(56) References Cited

FOREIGN PATENT DOCUMENTS

| | | | |
|---|---|---|---|
| KR | 2004-18934 | B1 | 6/2006 |
| KR | 20-2012-0002479 | U | 4/2012 |
| KR | 2004-75104 | B1 | 10/2014 |
| KR | 2004-75120 | A | 10/2014 |
| KR | 2004-75887 | A | 1/2015 |
| KR | 10-1532539 | B1 | 7/2015 |
| KR | 20-0479649 | Y1 | 2/2016 |

* cited by examiner

LIPSTICK VESSEL

TECHNICAL FIELD

The present invention relates to a lipstick vessel, and more particularly, to a lipstick vessel which does not allow outside air to enter the vessel when the lipstick is not in use, thereby preventing deterioration of the lipstick.

BACKGROUND ART

In general, the cosmetics which are used as a tool for making up the face are used in different functions depending on each part of the face, especially a typical example of the cosmetics used as a tool to makeup the lips may be a lipstick or a lip liner.

Such a conventional lipstick vessel is embedded with a bar-shaped lipstick in a separate case to be used for applying colors on the part of lips, and a lip liner is used to draw the lip line to sharpen the outline of lips. It is a general trend that lip cosmetics such as lipstick and lip liner are used together in combination with lipsticks and lip liners of the same color system, which are produced in various colors according to preference of the user and are sold in the market.

Meanwhile, the lipstick vessel described above includes a main body which is rotated by using hands of a user and a lipstick vessel received with a lipstick, which is coupled and fixed to an upper portion of the main body and is lifted and lowered by rotation of the main body.

The solid type lipstick is inserted and accommodated in the lipstick vessel described above by using an automated machine. In this case, however, when the lipstick vessel which is rotatably coupled to the main body is shaken by an external impact during transportation, the problem arises that a part of the solid type lipstick is inserted in a state of being pulled out to the outside without being correctly positioned in the center of the main body.

PRIOR ART DOCUMENTS (Patent Document 1) Korean Utility Model Registration No. 475887 (Registered on Jan. 5, 2015)

(Patent Document 2) Korean Utility Model Registration No. 475104 (Registered on Oct. 31, 2014)

(Patent Document 3) Korean Utility Model Registration No. 475120 (Registered on Oct. 31, 2014)

(Patent Document 4) Korean Utility Model Registration No. 418934 (Registered on Jun. 8, 2006)

DISCLOSURE

Technical Problem

The present invention is devised to meet the above-described needs of the prior art, and it is an object of the present invention to provide a lipstick vessel which does not allow outside air to enter the vessel when the lipstick is not in use, thereby preventing deterioration of the lipstick.

Technical Solution

The lipstick vessel according to a first embodiment of the present invention includes: a cylindrical upper cover 10, the upper part of which is closed and the lower part thereof is opened; a shoulder 20 of a cylindrical member, the upper and lower parts of which are opened, which is inserted into the lower opening of the upper cover 10; a lower cover 30 of a cylindrical member, the upper part of which is opened and the lower part thereof is closed, and the upper opening portion thereof is inserted into the lower outer circumference of a circumferential protrusion 21 protruding outward at the center of the shoulder 20; a rotating body 40 of a cylindrical member, which is inserted into the lower cover 30 to rotate integrally with the lower cover 30; a lipstick holding member 50 for holding a lipstick 1 at the upper part thereof, which is inserted into the center of the rotating body 40 to be lifted and lowered while rotating integrally with the rotating body; a guide member 60, of which the upper and lower parts are opened and the outer circumference is tapered, which is provided between the rotating body 40 and the lipstick holding member 50 to guide so that the lipstick holding member 50 moves vertically when it is lifted and lowered; and a lipstick receiving member 70 of a cylindrical member, the upper and lower parts of which are opened and fixed to the tapered outer circumference of the guide member 60 so that the upper opening is tapered to protect the lipstick 1 inside the lipstick receiving member.

The shoulder 20 includes: a circumferential protrusion 21 protruding at a center; an upper circular groove 22 provided at the upper outer circumference with respect to the circumferential protrusion 21 so that a first circular protrusion 11 protruding in the circumferential direction from the lower inner circumference of the upper cover 10 is inserted therein; a circumferential lower circular groove 23 provided at the lower outer circumference of the circumferential protrusion 21 so that a second circular protrusion 31 protruding in the circumferential direction from the upper inner circumference of the lower cover 30 is inserted therein; and a packing member 24 in a belt shape, which is provided so as to cover and seal the upper surface and the outer circumferential surface of the shoulder 20 to closely contact the inner circumferential surface of the upper cover 10 so that the lipstick 1 is not contaminated by the outside air.

The lower cover 30 is provided with a plurality of vertical protrusions 32 at the lower inner circumference; and a plurality of vertical guide protrusions 33 for guiding when the rotating body 40 is inserted into the upper inner circumference of the lower cover 30.

The rotating body 40 is provided with a central protrusion rod 42 protruding from the bottom surface inside the center of the rotating body to safely seat a leg portion 51 of the holding member 50; and a spiral-shaped portion 43, in which a screw is formed on the inner circumferential wall spacing apart from the central protrusion rod 42 to be screw-coupled to a spiral engagement protrusion 52 of the leg portion 51.

The lipstick holding member 50 includes: a holding portion 53 in the shape of a cylinder, which holds a lipstick 1 vertically at the upper portion thereof; a leg portion 51 in the shape of a circular rod, protruding downward at the center of the lower end surface of the holding portion 53; a spiral engagement protrusion 52 which is protruded to both sides at the lower end of the leg portion 51 to be screw-coupled to the spiral-shaped portion 43 of the rotating body 40; a guide protrusion 54 protruding in the direction perpendicular to the two spiral engagement protrusions 52, which is guided to be inserted into the guide member 60; and a contact protrusion 55, a plurality pieces of which are protruded on the inner circumferential wall of the leg portion 51 to which the central protrusion rod 42 of the rotating body 40 is inserted to be in close contact with the outer circumference of the central protrusion rod 42.

The guide member 60 includes: a square-shaped through-hole 61 which penetrates the upper surface, into which the leg portion 51 of the lipstick holding member 50 is inserted;

a pair of first guide grooves 62 which is formed on the side surfaces facing the square-shaped through-hole 61, into which the spiral engagement protrusion 52 of the leg portion 51 is inserted; a pair of second guide grooves 63 which is formed on the surfaces perpendicular to the first guide grooves 62, into which the guide protrusion 54 of the leg portion 51 is inserted; a circumferential coupling groove 64 which is formed on the inner circumferential upper side thereof so that a coupling protrusion 44 protruding in the circumferential direction from the upper outer circumference of the rotating body 40 is inserted therein; and a support protrusion 65 protruding from the outer circumferential lower end thereof and supporting so that the lower end of the lipstick receiving member 70 is safely seated.

Advantageous Effects

According to the lipstick vessel of the present invention, it does not allow outer air to enter the vessel when the lipstick is not in use, thereby preventing deterioration of the lipstick and guiding the lipstick receiving member to be lifted and lowered vertically.

BEST MODE

Figure 1:
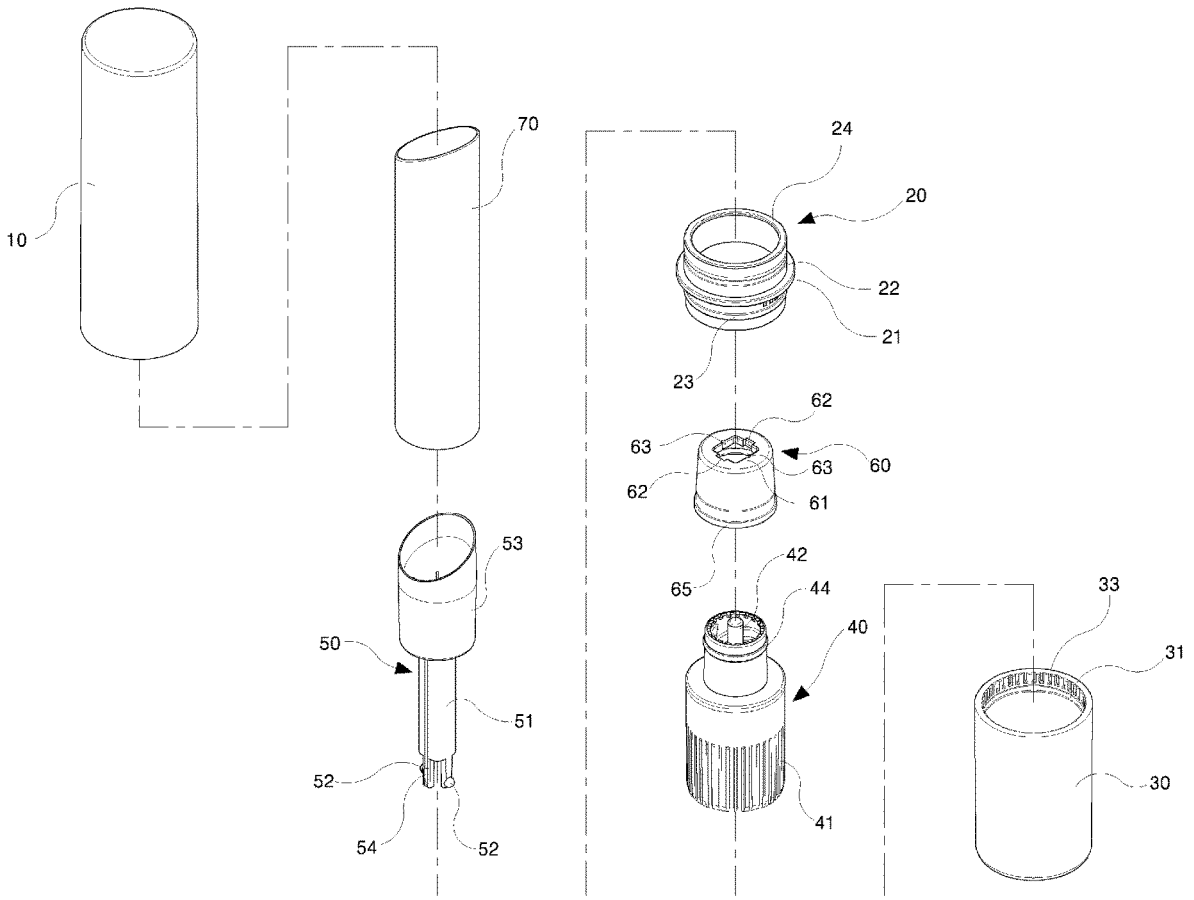
FIG. 1 is an exploded perspective view showing a lipstick vessel according to the present invention.

Hereinafter, preferred embodiments of the present invention will be described in detail with reference to the accompanying drawings so that these can easily be carried out by those skilled in the art. It should be noted that reference numerals shown in the attached drawings are used to denote the same components throughout the different drawings whenever possible. In addition, in describing the present invention, the detailed description of known functions or known configurations incorporated herein will be omitted if it is deemed that it may unnecessarily obscure the gist of the present invention. Some features shown in the drawings are magnified, reduced, or simplified for ease of explanation, and the drawings and their components are not necessarily illustrated at an appropriate rate. However, those skilled in the art will easily understand these details.

It will be understood that the terms including ordinals such as "first," "second," etc. may be used herein to describe various components, but these components are not limited to the terms. These terms are used only to distinguish one component from another component. For example, the first component may be referred to as a second component without departing from the scope of the claims of the present invention, and similarly, the second component may also be referred to as a first component. The term "and/or" includes any combination of a plurality of related listed items or any of a plurality of related listed items.

In addition, related terms described on the basis of what is shown in the drawings such as "front surface," "rear surface," "top surface," "below surface," and the like may be replaced with ordinals such as "first," "second," and the like.

The ordinal numbers such as "first," "second," and the like are arbitrarily set in the order described, and thus the order may be arbitrarily changed as necessary.

The terminology used herein is for the purpose of describing particular embodiments only and is not intended to be limiting of the invention. The singular forms comprise plural referents unless the context clearly dictates otherwise. It is to be understood that the terms such as "comprise" or "have" as described in the present specification, are intended to designate the presence of stated features, numbers, steps, operations, components, parts or combinations thereof, but not to preclude the possibility of the presence or addition of one or more other features, numbers, steps, operations, components, parts, or combinations thereof.

Unless otherwise defined, all terms including technical and scientific terms used herein have the same meaning as commonly understood by those skilled in the art to which the present invention pertains. The terms defined in commonly used dictionaries should be interpreted as having a meaning that is consistent with their meaning in the context of the relevant arts, and will not be interpreted in an idealized or overly formal meaning unless expressly so defined herein.

Hereinafter, preferred embodiments of the present invention will be described in detail with reference to the accompanying drawings. In addition, in describing the present invention, the detailed description of known configurations or functions incorporated herein will be omitted if it is deemed that it may unnecessarily obscure the gist of the present invention.

EMBODIMENT

Hereinafter, preferred embodiments of a lipstick vessel a accor According to the present invention will be described in detail with reference to the accompanying drawings.

Figure 2:
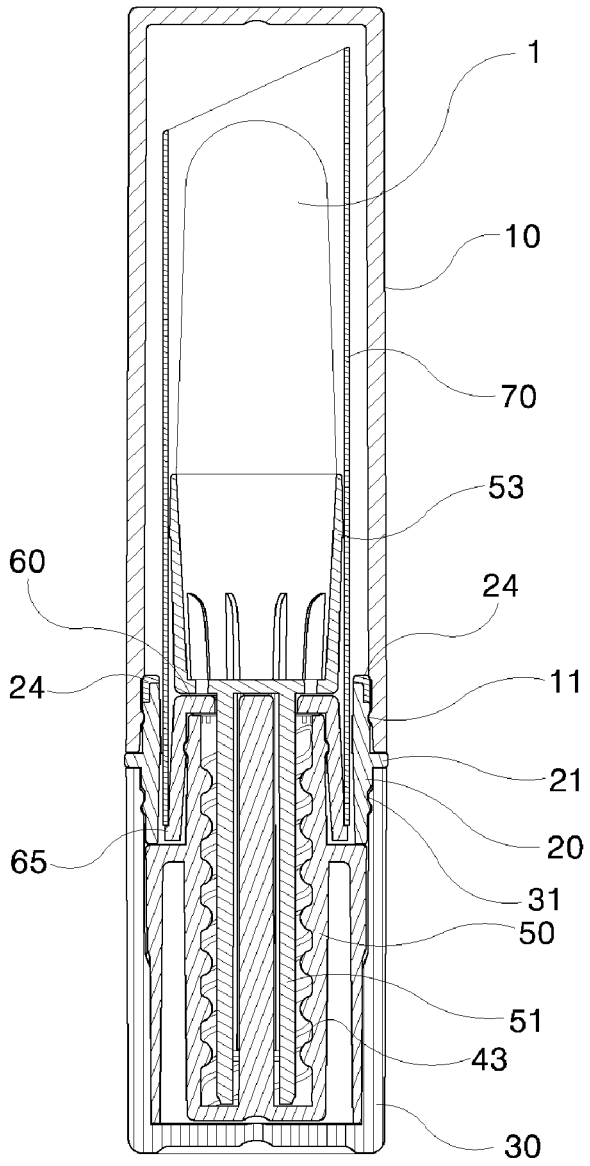
FIG. 2 is an assembled sectional view showing the lipstick vessel according to the present invention.
Figure 3:
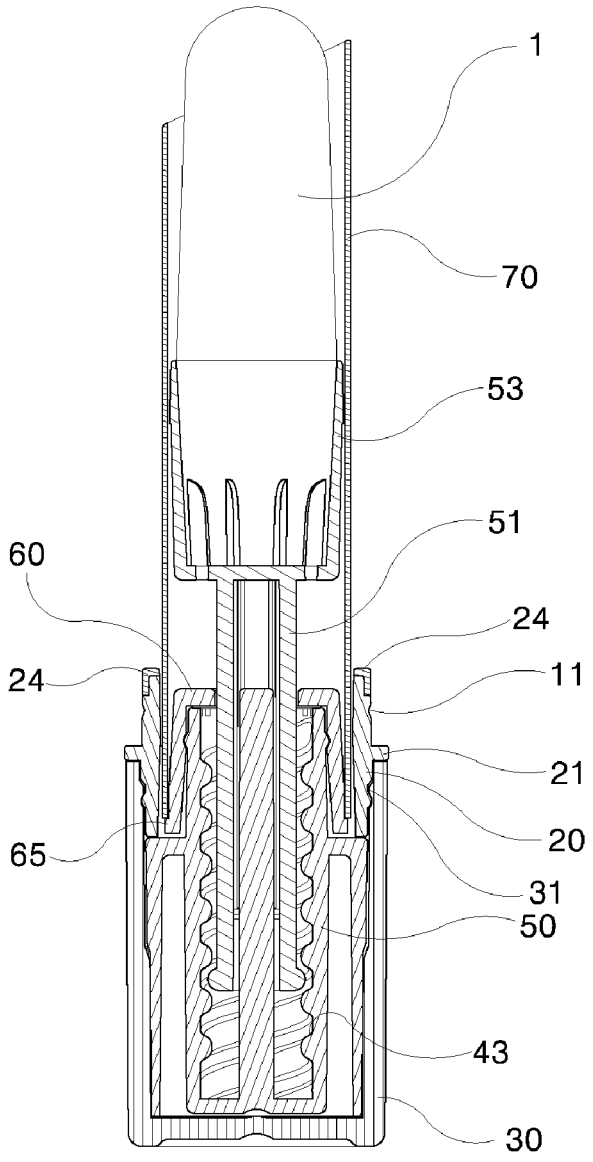
FIG. 3 is a cross-sectional view showing the use of the lipstick vessel according to the present invention.
Figure 4:
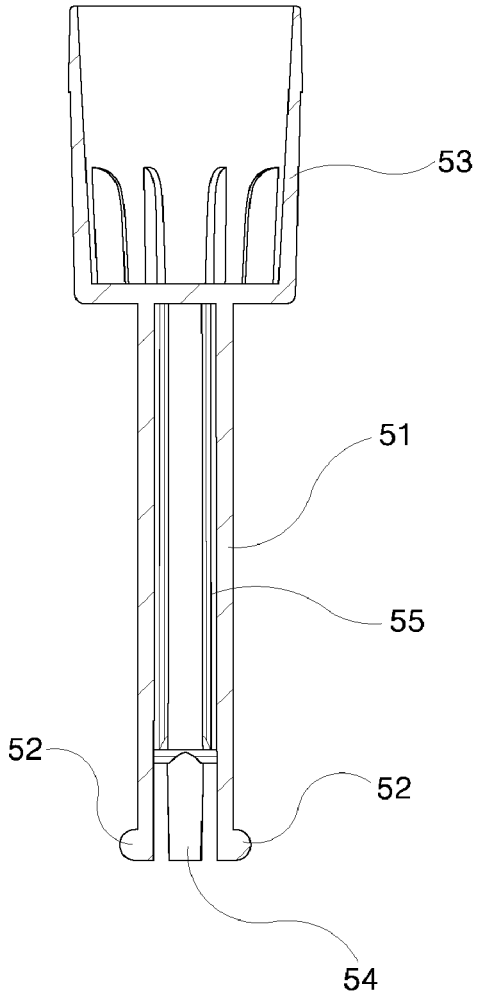
FIG. 4 is a cross-sectional view showing a lipstick holding member of the lipstick vessel according to the present invention.
Figure 5:
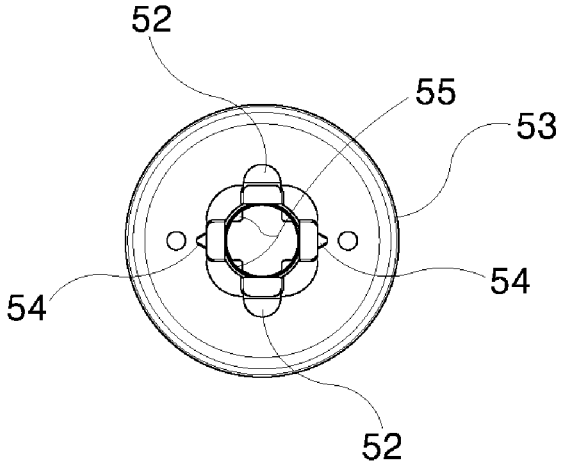
FIG. 5 is a bottom view showing the lipstick holding member of the lipstick vessel according to the present invention.
Figure 6:
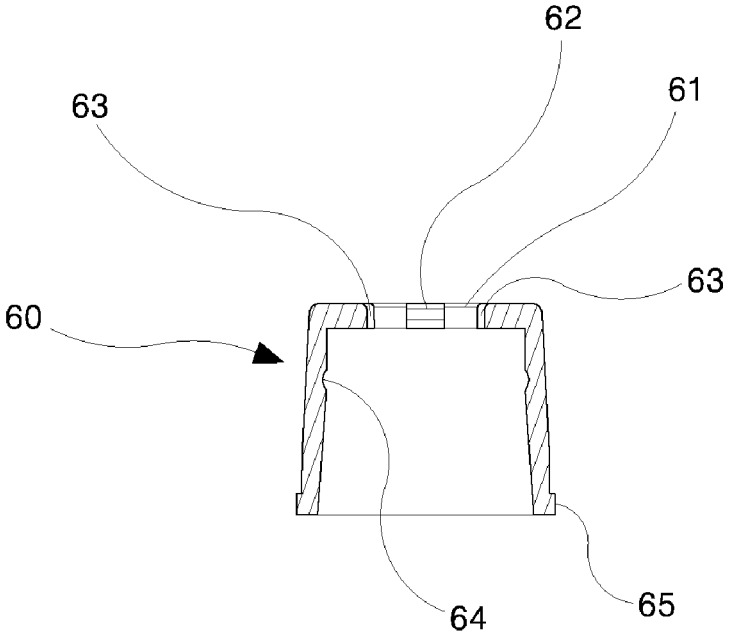
FIG. 6 is a cross-sectional view showing a guide member of the lipstick vessel according to the present invention.
Figure 7:
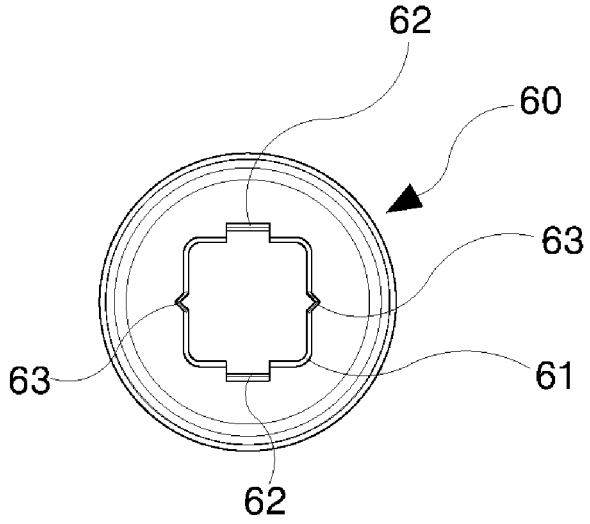
FIG. 7 is a plan view showing the guide member of the lipstick vessel according to the present invention.
Figure 8:
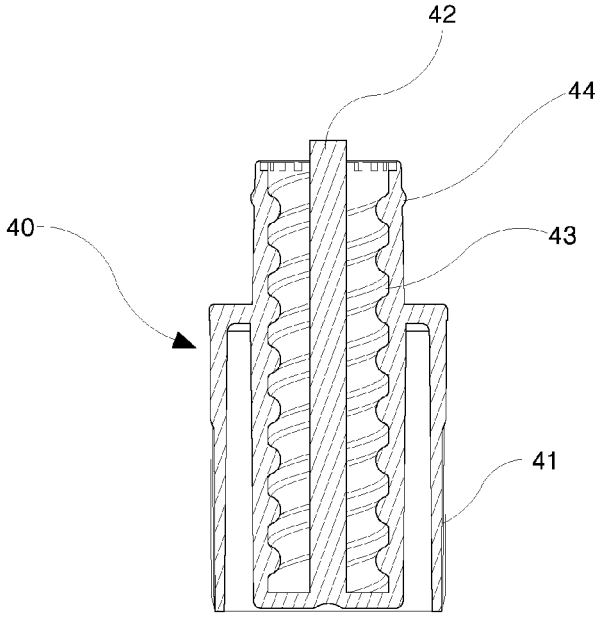
FIG. 8 is a cross-sectional view showing a rotating body of the lipstick vessel according to the present invention.
Figure 9:
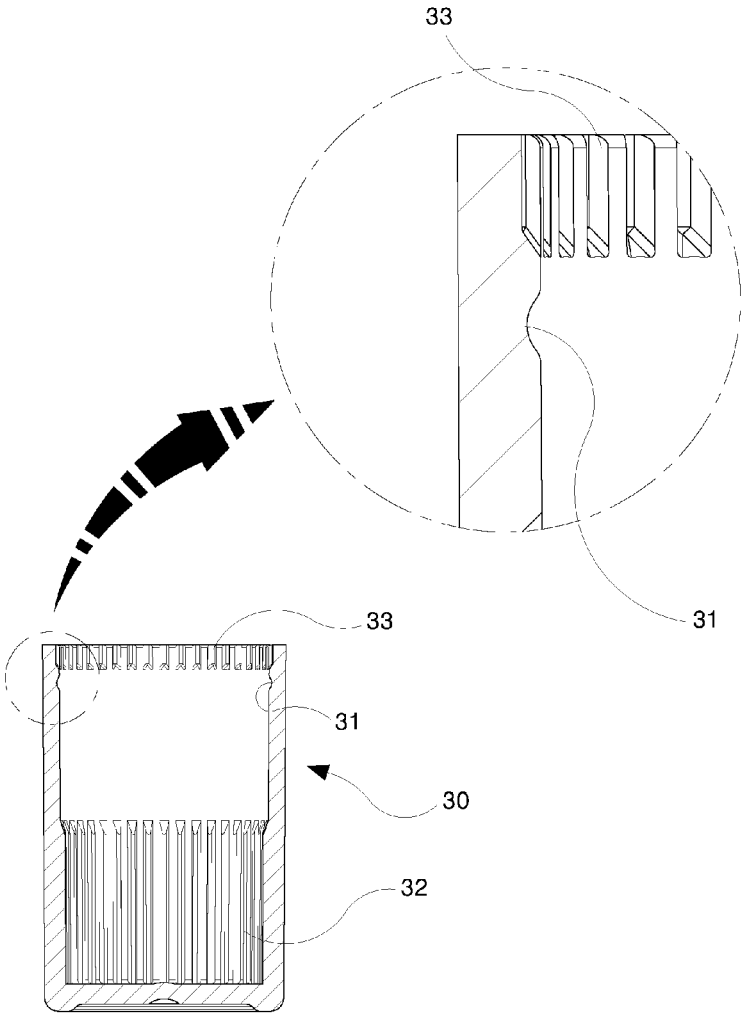
FIG. 9 is a cross-sectional view showing a lower cover of the lipstick vessel according to the present invention.

FIG. 1 is an exploded perspective view showing a lipstick vessel according to the present invention, FIG. 2 is an assembled sectional view showing the lipstick vessel according to the present invention, FIG. 3 is a cross-sectional view showing the use of the lipstick vessel according to the present invention, FIG. 4 is a cross-sectional view showing a lipstick holding member of the lipstick vessel according to the present invention, FIG. 5 is a bottom view showing the lipstick holding member of the lipstick vessel according to the present invention, FIG. 6 is a cross-sectional view showing a guide member of the lipstick vessel according to the present invention, FIG. 7 is a plan view showing a guide member of the lipstick vessel according to the present invention, FIG. 8 is a cross-sectional view showing a rotating body of the lipstick vessel according to the present invention, and FIG. 9 is a cross-sectional view showing a lower cover of the lipstick vessel according to the present invention.

The configuration of the lipstick vessel will be described with reference to FIGS. 1 to 6.

The lipstick vessel according to the present invention includes: a cylindrical upper cover 10, the upper part of which is closed and the lower part thereof is opened; a shoulder 20 of a cylindrical member, the upper and lower parts of which are opened, which is inserted into the lower opening of the upper cover 10; a lower cover 30 of a cylindrical member, the upper part of which is opened and the lower part thereof is closed, and the upper opening portion thereof is inserted into the lower outer circumference of a circumferential protrusion 21 protruding outward at a center of the shoulder 20; a rotating body 40 of a cylindrical member, which is inserted into the lower cover 30 to rotate integrally with the lower cover 30; a lipstick holding member 50 for holding a lipstick 1 at the upper part thereof, which is inserted into the center of the rotating body 40 to be lifted and lowered while rotating integrally with the rotating body; a guide member 60, of which the upper and lower parts are opened and the outer circumference is tapered, which is provided between the rotating body 40 and the lipstick holding member 50 to guide so that the lipstick holding member 50 moves vertically when it is lifted and lowered; and a lipstick receiving member 70 of a cylindrical member, the upper and lower parts of which are opened and fixed to the tapered outer circumference of the guide member 60 so that the upper opening is tapered to protect the lipstick 1 inside the lipstick receiving member.

The shoulder 20 is provided with a cylindrical upper circular groove 22 at the upper outer circumference with respect to a circumferential protrusion 21 protruding at the center thereof, to which a first circular protrusion 11 protruding in the circumferential direction from the lower inner circumference of the upper cover 10 is inserted therein; and a cylindrical lower circular groove 23 at the lower outer circumference of the circumferential protrusion 21, to which a second circular protrusion 31 protruding in the circumferential direction from the upper inner circumference of the lower cover 30 is inserted therein.

On the upper end of the shoulder 20, a packing member 24 in a belt shape, which is provided so as to cover and seal the upper surface and the outer circumferential surface of the shoulder 20 to closely contact the inner circumferential surface of the upper cover 10 so that the lipstick 1 is not contaminated by the outside air.

The lower cover 30 is provided with a plurality of vertical protrusions 32 at the lower inner circumference. The plurality of vertical protrusions 32 are inserted into a plurality of vertical grooves 41 formed at the lower outer circumference of the rotating body 40 to be rotatable depending on the rotation of the lower cover 30.

A plurality of vertical guide protrusions 33 are formed even on the upper inner circumference of the lower cover 30 so as to guide when the rotating body 40 is inserted.

The rotating body 40 is provided with a central protrusion rod 42 protruding from the bottom surface inside the center of the rotating body to safely seat a leg portion 51 of the lipstick holding member 50; and a spiral-shaped portion 43, in which a screw is formed on the inner circumferential wall spacing apart from the central protrusion rod 42 to be screw-coupled to a spiral engagement protrusion 52 of the leg portion 51.

The lipstick holding member 50 includes: a holding portion 53 in the shape of a cylinder, which holds a lipstick 1 vertically at the upper portion thereof; a leg portion 51 in the shape of a circular rod, protruding downward at the center of the lower end surface of the holding portion 53; a spiral engagement protrusion 52 which is protruded to both sides at the lower end of the leg portion 51 to be screw-coupled to the spiral-shaped portion 43 of the rotating body 40; a guide protrusion 54 protruding in the direction perpendicular to the two spiral engagement protrusions 52, which is guided to be inserted into the guide member 60; and a contact protrusion 55, a plurality pieces of which are protruded on the inner circumferential wall of the leg portion 51 to which the central protrusion rod 42 of the rotating body 40 is inserted to be in close contact with the outer circumference of the central protrusion rod 42.

The contact protrusion 55 guides so that the lipstick holding member 50 is lifted and lowered vertically.

The guide member 60 includes: a square-shaped through-hole 61 which penetrates the upper surface, into which the leg portion 51 of the lipstick holding member 50 is inserted; a pair of first guide grooves 62 which is formed on the side surface facing the square-shaped through-hole 61, into which the spiral engagement protrusion 52 of the leg portion 51 is inserted; a pair of second guide grooves 63 which is formed on the surfaces perpendicular to the first guide grooves 62, into which the guide protrusion 54 of the leg portion 51 is inserted; a circumferential coupling groove 64 which is formed on the inner circumferential upper side thereof so that a coupling protrusion 44 protruding in the circumferential direction from the upper outer circumference of the rotating body 40 is inserted therein; and a support protrusion 65 protruding from the outer circumferential lower end thereof and supporting so that the lower end of the lipstick receiving member 70 is safely seated.

Next, the function and the effect of the lipstick vessel configured as described above will be explained.

First, describing the assembly process of the lipstick container, since the rotating body 40 is inserted into the lower cover 30, when the vertical guide protrusion 33 formed on the upper inner circumference of the lower cover 30 is inserted into a plurality of vertical groves 41 of the rotating body 40 to be lowered, a plurality of vertical protrusions 32 of the lower cover 30 are inserted into the vertical grooves 41. In addition, since a guide member 60 is coupled to the upper part of the rotating body 40, a coupling protrusion 44 of the rotating body 30 is inserted into a circumferential coupling groove 64 formed on the upper inner circumference of the guide member 60.

In this state, the spiral engagement protrusion 52 is positioned on the spiral-shaped portion 43 while the spiral engagement protrusion 52 and the guide protrusion 54 which are formed in the leg portion 51 of the lipstick holding member 50 are inserted into the first and the second guide grooves 62, 63, respectively, and then is lowered to the lower part of the rotating body 40 as shown in FIG. 2 while rotating the spiral engagement protrusion.

In addition, the lipstick receiving member 70 is safely seated on the lower support protrusion 65 of the guide member 60 of which the outer circumference has the lower outer diameter tapered larger than the upper outer diameter.

Thereafter, when pushing the shoulder 20 downward through the outer side of the lipstick receiving member 70 to which the packing member 24 is coupled on the upper surface, the second circular protrusion 31 of the lower cover 30 is inserted into the lower circular groove 23 of the shoulder 20 to be rotatably coupled, and the central circumferential protrusion 21 is safely seated on the upper surface of the lower cover 30.

When closing the upper cover 10 in this state, the first circular protrusion 11 is inserted into the upper circular groove 22 of the shoulder 20, and the inner circumferential surface of the upper cover 10 is in contact with the packing member 24 to prevent outside air from entering into the lipstick vessel.

When rotating the lower cover 30 after opening the upper cover 10 to use the lipstick vessel, the spiral engagement protrusion 52 of the leg portion 51 engaged with the spiral-shaped portion 43 inside the lip cover is lifted along the spiral-shaped portion 43 to use the lipstick (FIG. 3).

Since the lipstick receiving member 50 is provided with the guide protrusion 54 which is formed on the outer circumferential surface of the leg portion 51 to be inserted into the second guide groove 63 of the guide member 60, it is lifted and lowered vertically without rotating depending on the rotation of the rotating body 40.

As described above, while the present invention has been described with respect to the specific embodiments, it will be apparent to those skilled in the art that various changes and modifications could be made without departing from the spirit and scope of the present invention as defined in the claims.

The invention claimed is:

1. A lipstick vessel, comprising:

a cylindrical upper cover including an upper part and a lower part, wherein the upper part is closed and the lower part is opened;

a shoulder including an upper part and a lower part, wherein the upper and lower parts of the shoulder are opened, and the shoulder is inserted into a lower opening of the cylindrical upper cover a lower cover including an upper part and a lower part, wherein the upper part of the lower cover is opened and the lower part of the lower cover is closed, and an upper opening portion of the lower cover is inserted into a lower outer circumference of a circumferential protrusion protruding outward at a center of the shoulder;

a rotating body of a cylindrical member, which is inserted into the lower cover to rotate integrally with the lower cover;

a lipstick holding member for holding a lipstick at an upper part thereof, which is inserted into a center of the rotating body to be lifted and lowered while rotating integrally with respect to the rotating body;

a guide member, of which an upper and a lower parts are opened and an outer circumference is tapered, which is provided between the rotating body and the lipstick holding member to guide so that the lipstick holding member moves vertically when it is lifted and lowered; and a lipstick receiving member of a cylindrical member, an upper and a lower parts of which are opened and fixed to the tapered outer circumference of the guide member so that an upper opening thereof is tapered to protect the lipstick inside the lipstick receiving member.

2. The lipstick vessel according to claim 1, wherein the shoulder comprises:

an upper circular groove provided at an upper outer circumference with respect to the circumferential protrusion so that a first circular protrusion protruding in the circumferential direction from a lower inner circumference of the upper cover is inserted therein;

a circumferential lower circular groove provided at a lower outer circumference of the circumferential protrusion so that a second circular protrusion protruding in the circumferential direction from the upper inner circumference of the lower cover is inserted therein; and a packing member in a belt shape, which is provided so as to cover and seal an upper surface and an outer circumferential surface of the shoulder to closely contact an inner circumferential surface of the upper cover so that the lipstick is not contaminated by outside air.

3. The lipstick vessel according to claim 2, wherein the rotating body comprises a central protrusion rod protruding from a bottom surface inside a center of the rotating body to safely seat a leg portion of the holding member; and a spiral-shaped portion, in which a screw is formed on an inner circumferential wall spacing apart from the central protrusion rod to be screw-coupled to a spiral engagement protrusion of the leg portion.

4. The lipstick vessel according to claim 1, wherein the lower cover is provided with a plurality of vertical protrusions at a lower inner circumference;

and a plurality of vertical guide protrusions for guiding when the rotating body is inserted into an upper inner circumference of the lower cover.

5. The lipstick vessel according to claim 4, wherein the rotating body comprises a central protrusion rod protruding from a bottom surface inside a center of the rotating body to safely seat a leg portion of the holding member; and a spiral-shaped portion, in which a screw is formed on an inner circumferential wall spacing apart from the central protrusion rod to be screw-coupled to a spiral engagement protrusion of the leg portion.

6. The lipstick vessel according to claim 1, wherein the rotating body comprises a central protrusion rod protruding from a bottom surface inside a center of the rotating body to safely seat a leg portion of the holding member; and a spiral-shaped portion, in which a screw is formed on an inner circumferential wall spacing apart from the central protrusion rod to be screw-coupled to a spiral engagement protrusion of the leg portion.

7. The lipstick vessel according to claim 6, wherein the lipstick holding member comprises:

a holding portion for holding the lipstick vertically at an upper portion thereof;

a leg portion protruding downward at a center of a lower end surface of the holding portion;

a spiral engagement protrusion which is protruded to both sides at a lower end of the leg portion to be screw-coupled to the spiral-shaped portion of the rotating body;

a guide protrusion protruding in a direction perpendicular to the spiral engagement protrusion, which is guided to be inserted into the guide member; and a contact protrusion, a plurality pieces of which are protruded on an inner circumferential wall of the leg portion to which the central protrusion rod of the rotating body is inserted to be in close contact with an outer circumference of the central protrusion rod.

8. The lipstick vessel according to claim 7, wherein the guide member comprises:

a square-shaped through-hole which penetrates an upper surface thereof, into which the leg portion of the lipstick holding member is inserted;

a pair of first guide grooves which are formed on side surfaces thereof facing the square-shaped through-hole, into which the spiral engagement protrusion of the leg portion is inserted;

a pair of second guide grooves which are formed on surfaces perpendicular to the first guide grooves, into which the guide protrusion of the leg portion is inserted;

a circumferential coupling groove which is formed on an inner circumferential upper side thereof so that a coupling protrusion protruding to a circumferential direction from an upper outer circumference of the rotating body is inserted into; and a support protrusion protruding from an outer circumferential lower end thereof and supporting so that a lower end of the lipstick receiving member is safely seated.

* * * * *